US008814967B2

(12) United States Patent
Upadhyay et al.

(10) Patent No.: US 8,814,967 B2
(45) Date of Patent: Aug. 26, 2014

(54) ABRASIVE ARTICLE AND METHOD OF MAKING

(75) Inventors: Rachana Upadhyay, Shrewsbury, MA (US); Srinivasan Ramanath, Holden, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 0 days.

(21) Appl. No.: 13/539,124

(22) Filed: Jun. 29, 2012

(65) Prior Publication Data

US 2013/0000211 A1 Jan. 3, 2013

Related U.S. Application Data

(60) Provisional application No. 61/503,380, filed on Jun. 30, 2011.

(51) Int. Cl.

| | |
|---|---|
| ***B24D 3/02*** | (2006.01) |
| ***B24D 3/04*** | (2006.01) |
| ***B24D 3/20*** | (2006.01) |
| ***B24D 5/00*** | (2006.01) |

(52) U.S. Cl.
USPC ..... 51/307; 51/293; 51/298; 51/300

(58) Field of Classification Search
USPC ..... 51/307, 295, 298
See application file for complete search history.

(56) References Cited

U.S. PATENT DOCUMENTS

| | | | | |
|---|---|---|---|---|
| 3,645,706 | A | 2/1972 | Bovenkerk et al. | |
| 3,779,727 | A | 12/1973 | Siqui et al. | |
| 3,899,307 | A | 8/1975 | Thompson | |
| 3,929,432 | A * | 12/1975 | Caveney | 51/295 |
| 3,957,461 | A | 5/1976 | Lindstrom et al. | |
| 3,984,214 | A | 10/1976 | Pratt et al. | |
| 4,399,167 | A * | 8/1983 | Pipkin | 427/217 |
| 4,475,926 | A | 10/1984 | Hickory | |
| 4,671,021 | A * | 6/1987 | Takahashi et al. | 451/540 |
| 4,712,332 | A | 12/1987 | Smith | |
| 5,063,714 | A | 11/1991 | Meyer | |
| 5,096,465 | A | 3/1992 | Chen et al. | |
| 5,104,422 | A * | 4/1992 | St. Pierre | 51/295 |
| 5,658,194 | A | 8/1997 | Micheletti | |
| 6,019,668 | A | 2/2000 | Ramanath et al. | |
| 6,093,092 | A | 7/2000 | Ramanath et al. | |
| 6,099,605 | A | 8/2000 | Cook et al. | |
| 6,102,789 | A | 8/2000 | Ramanath et al. | |
| 6,258,139 | B1 | 7/2001 | Jensen | |
| 6,596,225 | B1 | 7/2003 | Pope et al. | |
| 6,685,755 | B2 | 2/2004 | Ramanath et al. | |
| 6,755,729 | B2 | 6/2004 | Ramanath et al. | |
| 7,507,267 | B2 | 3/2009 | Hall et al. | |
| 7,658,665 | B2 | 2/2010 | Subramanian et al. | |
| 7,677,954 | B2 | 3/2010 | Hall et al. | |
| 7,828,627 | B2 | 11/2010 | Hall et al. | |
| 2003/0050000 | A1 | 3/2003 | Nonogawa et al. | |
| 2003/0091826 | A1 | 5/2003 | Abe et al. | |
| 2003/0194947 | A1 | 10/2003 | Bright et al. | |
| 2003/0232586 | A1 | 12/2003 | Ramanath et al. | |
| 2005/0026553 | A1 | 2/2005 | Bonner et al. | |
| 2005/0076577 | A1 * | 4/2005 | Hall et al. | 51/293 |
| 2005/0121417 | A1 | 6/2005 | Dixon et al. | |
| 2005/0272349 | A1 | 12/2005 | Burgess | |
| 2006/0102389 | A1 | 5/2006 | Wiseman et al. | |
| 2007/0037492 | A1 | 2/2007 | Hood et al. | |
| 2007/0216071 | A1 | 9/2007 | Peterman, Jr. et al. | |
| 2007/0275641 | A1 | 11/2007 | Subramanian et al. | |
| 2008/0293328 | A1 | 11/2008 | Hall et al. | |
| 2009/0093198 | A1 | 4/2009 | Subramanian et al. | |
| 2009/0151267 | A1 * | 6/2009 | Upadhyay et al. | 51/298 |
| 2009/0152018 | A1 | 6/2009 | Sani | |
| 2010/0159806 | A1 | 6/2010 | Wu et al. | |
| 2012/0036789 | A1 | 2/2012 | Upadhyay et al. | |
| 2012/0055098 | A1 | 3/2012 | Ramanath et al. | |
| 2012/0066982 | A1 | 3/2012 | Ramanath et al. | |
| 2013/0000211 | A1 | 1/2013 | Upadhyay et al. | |

FOREIGN PATENT DOCUMENTS

| | | | | |
|---|---|---|---|---|
| JP | 2002-066928 | A | 3/2002 | |
| JP | 4159262 | B2 | 10/2008 | |
| JP | 2001-252874 | A1 | 9/2011 | |
| WO | WO 97/37815 | * | 10/1997 | B24D 3/18 |
| WO | 2011/072298 | A2 | 6/2011 | |
| WO | 2012/024267 | A2 | 2/2012 | |
| WO | 2012/024277 | A2 | 2/2012 | |
| WO | 2013/003817 | A1 | 1/2013 | |

OTHER PUBLICATIONS

International Search Report; Application No. PCT/US2012/045124; 1 page.

International Search Report from PCT/US2011/047887 mailed Mar. 8, 2012.

International Search Report from PCT/US2011/047870 mailed Feb. 22, 2012.

Boedeker Plastics, Inc., "Celazole PBI PolyBenzlmidazole Datasheet", Copyright Boedeker Plastics, Inc., 2014, 3 pages.

* cited by examiner

*Primary Examiner* — Pegah Parvini

(74) *Attorney, Agent, or Firm* — Joseph P. Sullivan; Abel Law Group, LLP

(57) ABSTRACT

An abrasive article includes a bonded abrasive having a body made of abrasive grains contained within a composite bond material. The composite bond material can include an organic material and a metal material. The body can also include a filler material made of a superabrasive material. In an embodiment, the filler material can have an average particle size at least about 10 times less than an average particle size of the abrasive grains.

20 Claims, 3 Drawing Sheets

ABRASIVE ARTICLE AND METHOD OF MAKING

PRIORITY CLAIM AND CROSS-REFERENCE TO RELATED APPLICATION

This application claims priority to U.S. Provisional Patent Application No. 61/503,380 filed on Jun. 30, 2011, and entitled "Abrasive Article and Method of Making," and naming Rachana Upadhyay and Srinivasan Ramanath, as inventors, which is incorporated by reference herein in its entirety.

BACKGROUND

1. Field of the Disclosure

The following is directed to abrasive articles, and more particularly, bonded abrasive articles comprising superabrasive materials.

2. Description of the Related Art

Abrasives used in machining applications typically include bonded abrasive articles and coated abrasive articles. Coated abrasive articles generally include a layered article including a backing and an adhesive coat to fix abrasive grains to the backing, the most common example of which is sandpaper. Bonded abrasive tools consist of rigid, and typically monolithic, three-dimensional, abrasive composites in the form of wheels, discs, segments, mounted points, hones and other tool shapes, which can be mounted onto a machining apparatus, such as a grinding or polishing apparatus.

Bonded abrasive tools usually have three phases including abrasive grains, bond material, and porosity, and can be manufactured in a variety of "grades" and "structures" that have been defined according to practice in the art by the relative hardness and density of the abrasive composite (grade) and by the volume percentage of abrasive grain, bond, and porosity within the composite (structure).

Some bonded abrasive tools may be particularly useful in grinding and polishing hard materials, such as single crystal materials used in electronics and optics as well as superabrasive materials for use in industrial applications, such as earth boring. For example, polycrystalline diamond compact (PDC) cutting elements are typically affixed to the head of drill bits for earth boring applications in the oil and gas industry. The PDC cutting elements include a layer of superabrasive material (e.g., diamond), which must be ground to particular specifications. One method of shaping the PDC cutting elements is use of bonded abrasive tools, which typically incorporate abrasive grains contained within an organic bond matrix.

The industry continues to demand improved methods and articles capable of grinding superabrasive workpieces.

SUMMARY

According to one aspect, an abrasive article includes a bonded abrasive having a body comprising abrasive grains contained within a composite bond material including an organic material and a metal material, wherein the body further includes a filler material comprising a superabrasive material, the filler material having an average particle size at least about 10 times less than an average particle size of the abrasive grains.

In another aspect, an article includes a body comprising abrasive grains contained within a composite bond material including an organic material and a metal material, wherein the body further includes a filler material comprising metal-coated superabrasive particles, wherein an average particle size of the filler material and average particle size of the abrasive grains define a bimodal particle size distribution.

In still another aspect, an abrasive article includes a body comprising abrasive grains contained within a composite bond material including an organic material and a metal material, wherein the body further includes a filler material comprising titanium coated diamond particles, wherein the filler material is chemically bonded to the composite bond material.

According to one aspect, an abrasive article includes a body including abrasive grains contained within a composite bond material including an organic material and a metal material, wherein the composite bond material comprise a ratio (OM/MM) of organic material (OM) to metal material (MM) of not greater than about 0.25, and wherein the body comprises a filler material comprising metal-coated superabrasive particles.

In yet another aspect, an abrasive article includes a body having between about 45 to about 60 vol % composite bond material including organic material and metal material, between about 35 to about 45 vol % abrasive particles comprising a superabrasive material, and a remainder content of filler material comprising superabrasive particles, the filler material having an average particle size at least 10 times less than an average particle size of the abrasive grains.

According to another aspect, a method of forming an abrasive article includes forming a mixture including organic material, metal material, abrasive grains and a filler material, and treating the mixture to form an abrasive article having a body including abrasive grains and filler material contained within a composite bond material comprising an organic material and a metal material, wherein the filler material is chemically bonded to composite bond material.

BRIEF DESCRIPTION OF THE DRAWINGS

The present disclosure may be better understood, and its numerous features and advantages made apparent to those skilled in the art by referencing the accompanying drawings.

DETAILED DESCRIPTION

Figure 1:
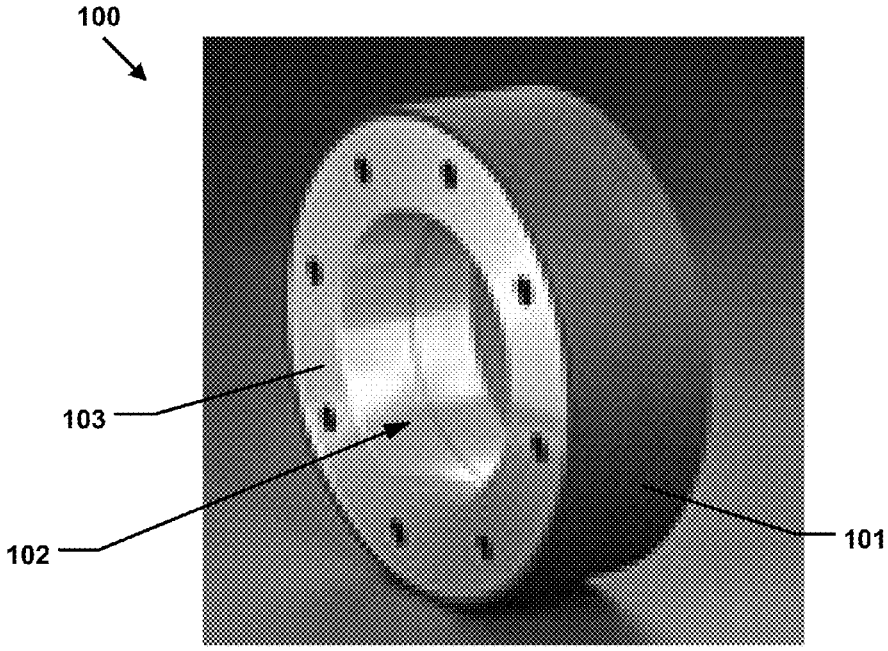
FIG. 1 includes an illustration of an abrasive article in accordance with an embodiment.

The following is generally directed to abrasive articles and methods of using such abrasive articles for use in certain grinding operations. Notably, the following embodiments can include abrasive articles that may be suitable for grinding of workpieces comprising superabrasive materials, including for example, polycrystalline diamond compacts, and other materials of this nature.

In reference to the process of forming a bonded abrasive article according to one embodiment, a mixture can initially be formed. The mixture can include abrasive grains, a bond material, and a filler material. According to one embodiment, the bond material can be a composite bond material, including at least two distinct types of materials. For example, the composite bond material can include an organic material and a metal material. In particular instances, formation of the mixture can include combining the abrasive grains with one of the components of the composite bond material, and then addition of the second component to the mixture. In one embodiment, the abrasive grains may first be mixed with the organic material.

The abrasive grains can include materials such as oxides, carbides, borides, and nitrides and a combination thereof. In particular instances, the abrasive grains can include superabrasive materials such as diamond, cubic boron nitride, and a combination thereof. Certain embodiments may utilize abrasive grains that consist essentially of diamond.

In further reference to the abrasive grains, the abrasive grains can have an average particle size of less than about 400 microns. In other instances, the abrasive grains can have an average particle size of less than about 300 microns, such as less than about 275 microns, or even less than about 250 microns. Certain abrasive articles may utilize abrasive grains having an average particle size of at least about 50 microns, such as at least about 80 microns, at least about 90 microns, or even at least about 100 microns. It will be appreciated that the average particle size of the abrasive grains can be within a range between any of the maximum and minimum values noted above. For example, the average particle size of the abrasive grains can be within a range between about 50 microns and about 400 microns.

The mixture may utilize more than one type of abrasive grain. Moreover, the mixture may use abrasive grains having more than one average particle size. That is, for example, a mixture of abrasive grains can be used that includes large and small particle sizes.

The mixture can contain a certain content of abrasive grains such that the finally-formed bonded abrasive body includes at least about 5 vol % abrasive grains for the total volume of the body. It will be appreciated that for other exemplary abrasive articles, the content of abrasive grains within the body can be greater, such as at least about 10 vol %, at least about 20 vol %, at least about 30 vol % or even at least about 40 vol % of the total volume of the body. In some abrasive articles, the mixture can contain an amount of abrasive grains such that the finally-formed body contains between about 5 vol % and about 60 vol %, and more particularly, between about 5 vol % and 50 vol % abrasive grains for the total volume of the body.

According to one embodiment, the mixture can also include a filler material. Suitable filler materials can include superabrasive materials, which are distinct from the abrasive grains by shape, size, grade, and a combination thereof. In one instance, the filler material can include diamond, and may consist essentially of diamond particles.

In certain instances the filler material can be a particulate material, wherein each particle has a core and a shell layer overlying the core. The core can include superabrasive particulate material, including for example, diamond grit. According to one embodiment, the shell layer can include at least one metal element. Suitable metal elements can include transition metal elements. The shell layer can include a single metal element or an alloy of metal elements. According to one embodiment, the shell layer can include titanium. In more particular instances, the shell layer can consist essentially of titanium. In still a more particular embodiment, the filler material can include metal-coated superabrasive particles, such as titanium-coated diamond particles.

The shell layer may include at least one metal element that is different than a metal material present within the bond material. In particular, the bond material can include a metal material, and the shell layer can be made of a material that is different than the composition of the metal material. More particularly, the shell layer can include a metal composition that is completely distinct and dissimilar from the composition of the metal material composition, such that the shell layer and metal material do not necessarily have any elemental components in common.

The filler material can have an average particle size that is significantly less than the average particle size of the abrasive grains. For example, in one embodiment, the filler material may have an average particle size that is at least about 10 times less than the average particle size of the abrasive grains. In another embodiment, the filler material can have an average particle size that is at least about 12 times, such as at least about 14 times, or even at least about 15 times less than the average particle size of the abrasive grains. In still other instances, the filler material may have an average particle size that is not greater than about 40 times, such as not greater than about 35 times, or even not greater than about 30 times smaller than the average particle size of the abrasive grains. It will be appreciated that the filler material can have an average particle size relative to the average particle size of the abrasive grains within a range between any of the values noted above.

Notably, the filler material and the abrasive grains can define a bimodal particle size distribution. That is, the filler material can have an average particle size that is significantly smaller than the average particle size of the abrasive grains, in some instances, an order of magnitude less, thus defining two distinct modes as plotted on a frequency vs. particle size chart. That is, a first mode associated with the average particle size of the filler material is distinct and separate from a second mode defined by the average particle size of the abrasive grains.

In more particular embodiments, the filler material can have an average particle size of not greater than about 25 microns. In other instances, the filler material can have an average particle size that is not greater than about 22 microns, not greater than about 20 microns, not greater than about 18 microns, or even not greater than about 16 microns. Still, the filler material may have an average particle size that is at least about 0.5 microns, such as at least about 1 micron, at least about 2 microns, at least about 4 microns, or even at least about 6 microns. It will be appreciated that the filler material can have an average particle size within a range between any of the maximum and minimum values noted above.

The mixture and the final-formed abrasive article of the embodiments herein can include a certain content of filler material, which facilitates improved grinding performance. For example, the mixture can include at least about 2 vol % filler material for the total volume of the body. In certain other instances, the content of filler material within the mixture, and thus within the final-formed body of the abrasive article, can be greater, such as at least about 4 vol %, at least about 6 vol %, or even at least about 7 vol % of the total volume of the body. In some abrasive articles, the mixture can contain an amount of filler material of not greater than about 16 vol %, such as not greater than about 14 vol %, not greater than about 12 vol %, or even not greater than about 10 vol %. It will be appreciated that the mixture, and thus the final-formed bonded abrasive body can have an amount of filler material within a range between any of the minimum and maximum values noted above.

The mixture, and thus the final-formed body of the abrasive article can have a particular ratio between the amount of abrasive grain and filler material that facilitates improved grinding performance. For example, the mixture, and thus the body, can have a ratio of filler material to abrasive grains (FM/AG) of not greater than about 0.30, wherein FM is the volume percent of the filler material based on the total volume of the body and AG is the volume percent of the abrasive grains based on the total volume of the body. In other instances, the ratio (FM/AG) can be less, such as not greater than about 0.25, or even not greater than about 0.24. In still other instances, the ratio of filler material to abrasive grain can be at least about 0.12, such as at least about 0.14, at least about 0.16, or even at least about 0.18. It will be appreciated that the ratio can be within a range between any of the minimum and maximum values noted above.

The mixture, and thus the final-formed body of the abrasive article, can have a particular content of abrasive grain and filler material, such as at least about 38 vol % for the total volume of the body. In one embodiment, the content of abrasive grain and filler material can be at least about 40 vol %, at least about 42 vol % or even at least about 44 vol %. Still, the total content of abrasive grains and filler material may be not greater than about 55 vol %, such as not greater than about 52 vol %, not greater than about 50 vol %, or even not greater than about 48 vol %. It will be appreciated that the mixture, and thus the final-formed bonded abrasive body can have an amount of abrasive grains and filler material within a range between any of the minimum and maximum values noted above.

In reference to the organic material component of the bond material, some suitable organic materials include thermosets and thermoplastics. In particular, the bond material can include materials such as polyimides, polyamides, resins, aramids, epoxies, polyesters, polyurethanes, and a combination thereof. In accordance with a particular embodiment, the organic material can include a polybenzimidazole (PBI). Additionally, the bond material may include some content of resin material, such as phenolic resin. In such embodiments utilizing a resin, the resin can be present in minor amounts, and may be used in combination with other organic materials.

The mixture can contain a certain content of organic material such that the finally-formed bonded abrasive body includes not greater than about 20 vol % of organic material for the total volume of the bond material. In other embodiments, the amount of organic material within the bond material may be less, for example, not greater than about 18 vol %, not greater than about 16 vol %, not greater than about 14 vol %, or even not greater than about 10 vol %. In particular instances, the body can be formed such the organic material is present in an amount within a range between about 1 vol % and about 20 vol %, such as between about 1 vol % and about 19 vol %, within a range between about 8 vol % and about 15 vol % or within a range between about 10 vol % and 12 vol %.

After forming a mixture of organic material and abrasive grains, a metal material may be added to facilitate the formation a composite bond material, wherein the composite bond material contains the organic material and metal material. In certain instances, the metal material can include metals or metal alloys. The metal material may incorporate one or more transition metal elements. In accordance with one embodiment, the metal material can include copper, tin, and a combination thereof. In fact, embodiments herein may utilize a metal material that consists essentially of bronze, and contains a ratio of copper:tin of approximately 60:40 by weight.

A certain content of metal material may be added to the mixture, such that the finally-formed bonded abrasive body contains at least about 20 vol % metal material for the total volume of the bond material. In other instances, the amount of metal material within the composite bond material can be greater, such as on the order of at least about 30 vol %, at least about 40 vol %, at least about 50 vol %, or even at least about 60 vol %. Particular embodiments may utilize an amount of metal material within a range between about 20 vol % and about 99 vol %, such as between about 30 vol % and about 95 vol %, or even between about 50 vol % and about 95 vol % for the total volume of the composite bond material.

After forming the mixture containing the abrasive grains, organic material, and metal material, the mixture can be agitated or mixed for a sufficient duration to ensure uniform distribution of the components within each other. After ensuring the mixture is suitably mixed, the process of forming the abrasive article can continue by treating the mixture.

In accordance with one embodiment, treating the mixture can include a pressing process. More particularly, the pressing process can include a hot pressing process, wherein the mixture is heated and pressed simultaneously to give the mixture a suitable shape. The hot pressing operation can utilize a mold, wherein the mixture is placed in the mold, and during the hot pressing operation, the application of heat and pressure is utilized to form the mixture to the contours of the mold and give the mixture a suitable, finally-formed shape.

In accordance with one embodiment, the hot pressing operation can be conducted at a pressing temperature of not greater than about 600° C. The pressing temperature is considered the maximum soaking temperature utilized during hot pressing to facilitate proper formation of the bond material. In accordance with another embodiment, hot pressing process can be conducted at a pressing temperature of not greater than about 550° C., such as not greater than 500° C. In particular instances, hot pressing can be completed at a pressing temperature with a range between about 400° C. and 600° C. and more particularly within a range between about 400° C. and 490° C.

The pressing process can be conducted at a particular pressure that is a maximum and sustained pressure exerted upon the mixture suitable to form the mixture to the desired shape. For example, the hot pressing process can be conducted at a maximum pressing pressure of not greater than about 10 tons/in$^2$. In other embodiments, the maximum pressing pressure may be less, such as not greater than about 8 tons/in$^2$, not greater than about 6 tons/in$^2$. Still, certain hot pressing processes can utilize a pressing pressure within a range between about 0.5 tons/in$^2$ and about 10 tons/in$^2$, such as within a range between 0.5 tons/in$^2$ and 6 tons/in$^2$.

In accordance with an embodiment, the pressing process can be conducted such that the pressing pressure and pressing temperature are held for a duration of at least about 5 minutes. In other embodiments, the duration may be greater, such as at least about 10 minutes, at least about 20 minutes, or even at least 30 minutes.

Generally, the atmosphere utilized during the treating operation can be an inert atmosphere, comprising an inert species (e.g., noble gas), or a reducing atmosphere having a limited amount of oxygen. In other instances, the pressing operation can be conducted in an ambient atmosphere.

Upon completion of the hot pressing operation, the resulting form can be an abrasive article comprising abrasive grains contained within a composite bond material.

FIG. 1 includes an abrasive article in accordance with an embodiment. As illustrated, the abrasive article 100 can include a bonded abrasive body 101 having a generally annular shape and defining a central opening 102 extending axially through the body 101. The bonded abrasive body 101 can include abrasive grains contained within the composite bond material as described herein. In accordance with an embodiment, the abrasive article 100 can be an abrasive wheel having a central opening 102, which aids coupling of the bonded abrasive body to suitable grinding machinery, which is designed to rotate the abrasive article for material removal operations. Moreover, the insert 103 can be placed around the body 101 and define the central opening 102 and in particular instances, the insert 103 may be a metal material which can facilitate coupling of the body 101 to machinery.

The bonded abrasive body 101 can define an abrasive rim extending circumferentially around an edge of the abrasive article 100. That is, the body 101 can extend along the outer peripheral edge of the insert 103, which is affixed (e.g., using fasteners, adhesives, and a combination thereof) to the body 101.

The body 101 can have particular amounts of abrasive grain, bond material, and porosity. The body 101 can include the same amount (vol %) of abrasive grains as described in the mixture. The body 101 can also include the same amount (vol %) of filler material as described above with regard to the initial mixture. Furthermore, the ratio between the filler material and abrasive grains, as well as the total content of filler material and abrasive grains can be the same in the body as present in the mixture as described herein.

The body 101 can include at least about 10 vol % composite bond material for the total volume of the body. In other instances, the body 101 can include a greater content of composite bond material, such as at least about 20 vol %, at least about 30 vol %, at least about 40 vol %, or even at least about 50 vol % for the total volume of the body 101. In other instances, the body 101 can be formed such that the composite bond material comprises between about 10 vol % and about 80 vol %, such as between about 10 vol % and 60 vol %, or even between about 20 vol % and about 60 vol % bond material for the total volume of the body 101.

Notably, the body 101 can be formed to have a particular ratio based on the volume percent of the organic materials (OM) to metal materials (MM) contained within the composite bond material. For example, the composite bond material can have a ratio (OM/MM) of organic material by volume (OM) to metal material by volume (MM) having a value of not greater than about 0.25. In accordance with other embodiments, the abrasive article can be formed such that the composite bond material ratio is not great than about 0.23, such as not greater than about 0.20, not greater than about 0.18, not greater than about 0.15, or even not greater than about 0.12. In particular instances, the body can be formed such that the composite bond material has a ratio of organic material to metal material (OM/MM) within a range between about 0.02 and 0.25, such as between about 0.05 and 0.20, between about 0.05 and about 0.18, between about 0.05 and about 0.15, or even between about 0.05 and about 0.12.

The abrasive article may be formed such that the body 101 contains a certain content of porosity. For example, the body 101 can have a porosity of not greater than about 10 vol % for the total volume of the body 101. In other instances, the body 101 can have a porosity of not greater than about 8 vol %, such as not greater than about 5 vol %, or even not greater than about 3 vol %. Still, the body, 101 can be formed such that the porosity is within a range between 0.5 vol % and 10 vol %, such as between about 0.5 vol % and about 8 vol %, between about 0.5 vol % and about 5 vol %, or even between about 0.5 vol % and about 3 vol % of the total volume of the body 101. The majority of the porosity can be closed porosity comprising closed and isolated pores within the bond material. In fact, in certain instances, essentially all of the porosity within the body 101 can be closed porosity.

In addition to the features described herein, the body 101 can be formed such that it has a composite bond material wherein not less than about 82% of the abrasive grains within the body 101 are contained within the metal material of the composite bond material. For example, the body 101 can be formed such that not less than 85%, such as not less than about 87%, not less than about 90%, or even not less than about 92% of the abrasive grains within the body 101 are contained within the metal material of the composite bond material. The body 101 can be formed such that between about 82% to about 97%, and more particularly, between 85% and about 95% of the abrasive grains within the body 101 can be contained within the metal material of the bond material.

In addition to the features described herein, the body 101 can be formed such that it has a composite bond material wherein not less than about 82% of the abrasive grains within the body 101 are contained within the metal material of the composite bond material. For example, the body 101 can be formed such that not less than 85%, such as not less than about 87%, not less than about 90%, or even not less than about 92% of the abrasive grains within the body 101 are contained within the metal material of the composite bond material. The body 101 can be formed such that between about 82% to about 97%, and more particularly, between 85% and about 95% of the abrasive grains within the body 101 can be contained within the metal material of the bond material.

Furthermore, the body 101 can be formed such that not less than about 82% of the filler material within the body 101 can be contained within the metal material of the composite bond material. For example, the body 101 can be formed such that not less than 85%, such as not less than about 87%, not less than about 90%, or even not less than about 92% of the filler material within the body 101 is contained within the metal material of the composite bond material. The body 101 can be formed such that between about 82% to about 97%, and more particularly, between 85% and about 95% of the filler material within the body 101 can be contained within the metal material of the bond material.

In combination with other features, the filler material as described in embodiments herein can facilitate improved grinding performance and durability of the bonded abrasive body. For example, the filler material can be chemically bonded to the composite bond material. In certain embodiments utilizing a filler material made of a metal-coated superabrasive particle, the coating or shell layer may facilitate chemical bonding between the bond material, particularly the metal material of the composite bond material, and the core (e.g., superabrasive particle). In some forming processes according to the embodiments herein, the metal material of the composite bond material and the material of the shell layer of the filler material can react, facilitating interdiffusion of the shell layer material and metal material of the composite bond. In certain embodiments, interdiffusion can facilitate formation of a chemical bond and define an active region around the external surface of the core (i.e., superabrasive particulate).

The bonded abrasive article of the embodiments can utilize a composite bond having a fracture toughness of not greater than 3.0 MPa $m^{0.5}$. In fact, certain bonded abrasive articles can have a bond material having a fracture toughness that is not greater than about 2.5 MPa $m^{0.5}$, such as not greater than about 2.0 MPa $m^{0.5}$, or even not greater than about 1.8 MPa $m^{0.5}$. Certain bonded abrasive articles can utilize a composite bond material having a fracture toughness between about 1.5 MPa $m^{0.5}$ and about 3.0 MPa $m^{0.5}$, such as within a range between about 1.5 MPa $m^{0.5}$ and 2.5 MPa $m^{0.5}$ and even within a range between about 1.5 MPa $m^{0.5}$ and about 2.3 MPa $m^{0.5}$.

In another embodiment, the body can have an average wear of not greater than about 0.25 mm. The wear can be conducted on a Streurs polishing machine, wherein sample of the body in the form of a wheel of cross-section 0.257 inches×0.257 inches and approximately 0.75 inches in length. The sample is adhered to an aluminum cylinder measuring 1.25" in diameter and 1.5" long. The aluminum cylinder is held in a vertical position on the machine fixture. The sample is facing down and comes into contact with an abrasive disk. The abrasive disk contains 100 grit silicon carbide grits and is 10" in diameter. The load on the other end of the aluminum cylinder is set to 50 Newtons. The abrasive disk rotates at 150 rpm, and the contact between the abrasive disk and sample is 10 seconds under the 50 Newton load. The wear on the sample is measured as the reduction in thickness of the sample after conducting the test. In one embodiment, the average wear of the body can be less, such as not greater than about 0.2 mm, not greater than about 0.18 mm, not greater than about 0.13 mm, not greater than about 0.1 mm, or even not greater than about 0.08 mm. Still, the average wear can be at least about 0.005 mm, or even at least about 0.01 mm. It will be appreciated that the wear of the body can be within a range between any of the minimum and maximum values noted above.

For certain embodiments, the body can have a hardness of at least about 90 on the Rockwell B scale, tested using the standard 1/16" steel ball indenting the body under a 100 kg load. In other instances, the hardness of the body can be greater, such as at least about 95, at least about 100, at least about 105, at least about 108, or even at least about 110. Still, the hardness may be not greater than about 150. It will be appreciated that the wear of the body can be within a range between any of the minimum and maximum values noted above.

For certain embodiments, the body can have a G-ratio, which is a measure of the volume of material removed from the workpiece divided by the volume of material lost from the bonded abrasive body, of at least about 0.016. Notably, the G-ratio can be measured by grinding a superhard workpiece comprising superabrasive material, wherein before and after grinding, the wheel diameter and width are measured to determine the wheel volume consumed. Similar measurements on the work piece are conducted leading to G-Ratio calculations. In other instances, the G-ratio of the body can be greater, such as at least about 0.017, at least about 0.018, at least about 0.02, at least about 0.025, at least about 0.03, or even at least about 0.04. Still, the G-ratio of the body may not be greater than about 0.06, such as not greater than about 0.055, or even not greater than about 0.05. It will be appreciated that the G-ratio of the body can be within a range between any of the minimum and maximum values noted above.

The abrasive articles herein may be particularly suitable for removing material from particular workpieces, such as by a grinding process. In particular embodiments, the bonded abrasive articles of embodiments herein can be particularly suitable for grinding and finishing of workpieces incorporating super hard materials or superabrasive materials. That is, the workpieces can have an average Vicker's hardness of 5 GPa or greater. In fact, certain workpieces, which may be finished by the bonded abrasive articles of the embodiments herein, can have an average Vicker's hardness of at least about 10 GPa, such as at least about 15 GPa, or even at least about 25 GPa.

In fact, in certain instances, the bonded abrasive articles herein are particularly suitable for grinding of materials, which are also used in abrasive applications. One particular example of such workpieces includes polycrystalline diamond compact (PDC) cutting elements, which may be placed on the heads of earthboring drill bits used in the oil and gas industry. Generally, PDC cutting elements can include a composite material having an abrasive layer overlying a substrate. The substrate can be a cermet (ceramic/metallic) material. That is, the substrate can include some content of metal, typically an alloy or superalloy material. For example, the substrate can have a metal material that has a Mohs hardness of at least about 8. The substrate can include a metal element, which can include one or more transition metal elements. In more particular instances, the substrate can include a carbide material, and more particularly tungsten carbide, such that the substrate can consist essentially of tungsten carbide.

The abrasive layer of the workpiece may be bonded directly to the surface of the substrate. The abrasive layer can include hard materials such as carbon, fullerenes, carbides, borides, and a combination thereof. In one particular instance, the abrasive layer can include diamond, and more particularly may be a polycrystalline diamond layer. Some workpieces, and particularly PDC cutting elements, can have an abrasive layer consisting essentially of diamond. In accordance with at least one embodiment, the abrasive layer can be formed of a material having a Mohs hardness of at least about 9. Moreover, the workpiece may have a generally cylindrically shaped body, particularly in reference to PDC cutting elements.

It has been found that the bonded abrasive articles of embodiments herein are particularly suitable for grinding and/or finishing of workpieces incorporating super-hard materials (e.g., metal and metal alloys such as nickel-based superalloys and titanium-based super alloys, carbides, nitride, borides, fullerenes, diamond, and a combination thereof). During a material removal (i.e., grinding) operation, the bonded abrasive body can be rotated relative to the workpiece to facilitate material removal from the workpiece.

Figure 2:
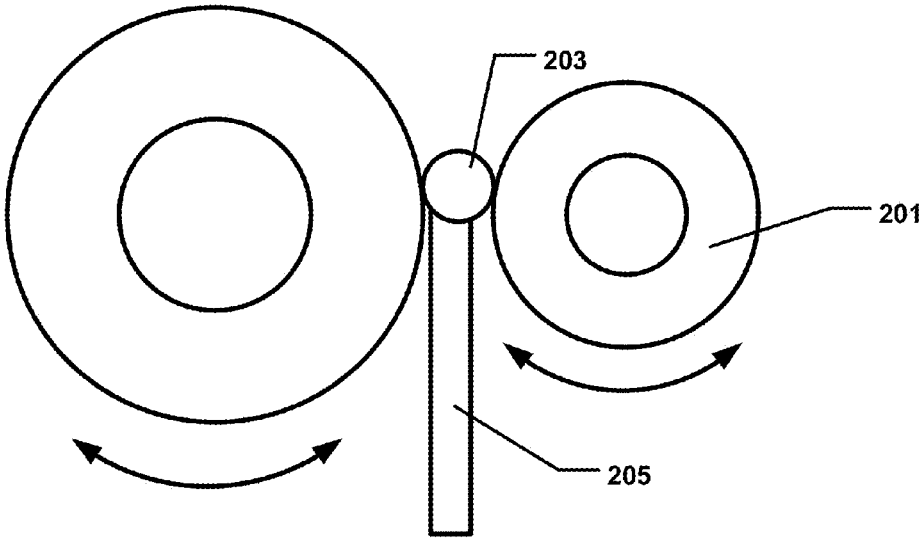
FIG. 2 includes a diagram of a grinding operation in accordance with an embodiment.

One such material removal process is illustrated in FIG. 2. FIG. 2 includes a diagram of a grinding operation in accordance with an embodiment. In particular, FIG. 2 illustrates a centerless grinding operation utilizing the abrasive article 100 in the form of an abrasive wheel incorporating the bonded abrasive body 101. The centerless grinding operation can further include a regulating wheel 201, which can be rotated at a particular speed to control the grinding process. As further illustrated, for a particular centerless grinding operation, a workpiece 203 can be disposed between the abrasive wheel 100 and the regulating wheel 201. The workpiece 203 can be supported in a particular position between the abrasive wheel 100 and the regulating wheel 201 by a support 205, configured to maintain the position of the workpiece 203 during grinding.

According to one embodiment, during centerless grinding, the abrasive wheel 100 can be rotated relative to the workpiece 203, wherein the rotation of the abrasive wheel 100 facilitates movement of the bonded abrasive body 101 relative a particular surface (e.g., a circumferential side surface of the cylindrical workpiece) of the workpiece 203, and thus, grinding of the surface of the workpiece 203. Additionally, the regulating wheel 201 can be rotated at the same time the abrasive wheel 100 is rotated to control the rotation of the workpiece 203 and control certain parameters of the grinding operation. In certain instances, the regulating wheel 201 can be rotated in the same direction as the abrasive wheel 100. In other grinding processes, the regulating wheel 201 and the abrasive wheel 100 can be rotated in opposite directions relative to each other.

It has been noted that by utilizing the bonded abrasive bodies of the embodiments herein, the material removal processes can be conducted in a particularly efficient manner as compared to prior art products and processes. For example, the bonded abrasive body can conduct grinding of a workpiece comprising a superabrasive material at an average specific grinding energy (SGE) of not greater than about 350 J/mm$^3$. In other embodiments, the SGE can be less, such as not greater than about 325 J/mm$^3$, such as greater than about 310 J/mm$^3$, not greater than about 300 J/mm$^3$, or even not greater than 290 J/mm$^3$. Still, for certain grinding operations, the bonded abrasive material can remove material from the workpiece at an average SGE within a range between about 50 J/mm$^3$ and about 350 J/mm$^3$, such as between about 75 J/mm$^3$ and about 325 J/mm$^3$, or even within a range of between about 75 J/mm$^3$ and about 300 J/mm$^3$.

It should be noted that certain grinding parameters (e.g., specific grinding energy) can be achieved in combination with other parameters, including for example, particular material removal rates (MRR). For example, the average material removal rate can be at least about 8 mm$^3$/sec. In fact, greater material removal rates have been achieved, such as on the order of at least about 10 mm$^3$/sec, such as at least about 12 mm$^3$/sec, at least about 14 mm$^3$/sec, at least about 16 mm$^3$/sec, or even at least about 18 mm$^3$/sec. In accordance with particular embodiments, grinding operations utilizing the bonded abrasive bodies herein can achieve average material removal rates within a range between about 8 mm$^3$/sec and about 40 mm$^3$/sec, such as between about 14 mm$^3$/sec and about 40 mm$^3$/sec, such as between about 18 mm$^3$/sec and about 40 mm$^3$/sec, and even between about 20 mm$^3$/sec and 40 mm$^3$/sec.

The grinding operation utilizing the bonded abrasive articles of embodiments herein and a workpiece comprising superabrasive material can be conducted at a threshold power that is not greater than about 150 W/mm Notably, the threshold power is normalized for the contact width of the abrasive article. In other embodiments, the threshold power during the grinding operation can be less, such as not greater than about 140 W/mm, not greater than about 130 W/mm, not greater than about 110 W/mm, not greater than about 100 W/mm, not greater than about 90 W/mm, or even not greater than about 75 W/mm Certain grinding operations can be conducted at a threshold power within a range between about 20 W/mm and about 150 W/mm, such as between about 20 W/mm and about 130 W/mm, such as between about 20 W/mm and 110 W/mm, or even between 20 W/mm and 90 W/mm.

Certain grinding properties (e.g., specific grinding energy, threshold power, material removal rates etc.) can be achieved in combination with particular aspects of the bonded abrasive and grinding process, including for example, particular wheel geometries. For example, the grinding properties herein can be achieved on abrasive articles in the shape of abrasive wheels (see, FIG. 1), wherein the wheels have a diameter of at least about 5 inches, at least about 7 inches, at least about 10 inches, or even at least about 20 inches. In certain instances, the abrasive wheel can have an outer diameter within a range between about 5 inches and about 40 inches, such as between about 7 inches and about 30 inches.

The grinding properties herein can be achieved on abrasive articles in the shape of abrasive wheels (see, FIG. 1), wherein the wheels can have a width, as measured across the width of the abrasive layer defining the rim of the wheel, of at least about 0.5 inches, at least about 1 inch, at least about 1.5 inches, at least about 2 inches, at least about 4 inches, or even at least about 5 inches. Particular embodiments can utilize an abrasive wheel having a width within a range between about 0.5 inches and about 5 inches, such as between about 0.5 inches and about 4 inches, or even between about 1 inch and about 2 inches.

In particular instances, the material removal operations include a centerless grinding operation wherein the speed of the abrasive wheel is at least about 900 m/min, such as on the order of at least about 1000 m/min, at least about 1200 m/min, or even at least about 1500 m/min Particular processes can utilize a grinding wheel speed within a range between about 1000 m/min and about 3000 m/min, such as between about 1200 m/min and about 2800 m/min, or even between about 1500 m/min and about 2500 m/min.

In particular instances, the material removal operations include a centerless grinding operation wherein the speed of the regulating wheel is at least about 5 m/min, such as on the order of at least about 10 m/min, at least about 12 m/min, or even at least about 20 m/min. Particular processes can utilize a regulating wheel speed within a range between about 5 m/min and about 50 m/min, such as between about 10 m/min and about 40 m/min, or even between about 20 m/min and about 30 m/min.

The grinding process may also utilize a particular through infeed rate per grinding operation, which is a measure of the radial depth of engagement between the abrasive article and the workpiece. In particular instances, the infeed rate per grind can be at least about 0.01 mm, at least about 0.02 mm, and even at least about 0.03 mm. Still, the grinding operation is typically set up such that the infeed rate per grind is within a range between about 0.01 mm and about 0.5 mm, or even between about 0.02 mm and about 0.2 mm. Additionally, the grinding process can be completed such that the through-feed rate of the workpieces is between about 20 cm/min and about 150 cm/min, and more particularly between about 50 cm/min and about 130 cm/min.

It will further be appreciated that in certain centerless grinding operations, the regulating wheel can be angled relative to the workpiece and the abrasive wheel to facilitate through-feed of the workpieces. In particular instances, the regulating wheel angle is not greater than about 10 degrees, such as not greater than about 8 degrees, not greater than about 6 degrees, and even not greater than about 4 degrees. For certain centerless grinding operations, the regulating wheel can be angled relative to the workpiece and the abrasive wheel within a range between about 0.2 degrees and about 10 degrees, such as between about 0.5 degrees and about 5 degrees, and more particularly within a range between about 1 degree and about 3 degrees.

Example

The following includes a comparative example of a bonded abrasive body (S1) formed according to an embodiment herein compared to a conventional abrasive material (C1) designed to grind superabrasive materials.

Sample S1 is formed by combining a mixture of abrasive grains and filler material, wherein the abrasive grains are diamond having an average size of U.S. mesh 100/120 (i.e., average particle size of 125-150 microns) and filler material having a U.S. mesh size of 1200/4800 (i.e., average particle size of 2-12 microns). The ratio of filler material to abrasive grains is approximately 0.21.

The abrasive grains and filler material are mixed with an organic bond material consisting of polybenzimidazole (PBI) commercially available from Boedeker Plastics Inc. Thereafter, metal bond is added to the mixture. The metal bond material is a bronze (60/40 of Sn/Cu) composition available as DA410 from Connecticut Engineering Associates Corporation.

The mixture is thoroughly mixed and poured into a mold. The mixture is then hot pressed according to the following procedures. Initially, a line pressure of 60 psi is applied to the mixture. The mixture is then heated to 395° C. A full pressure of 10 tons/in$^2$ is then applied and the mixture is heated to 450° C. for 20 minutes, followed by a cool down.

The finally-formed bonded abrasive article is formed into the shape of an abrasive wheel having an outer diameter of 8 inches and a wheel width of approximately 1 inch. The bonded abrasive article has approximately 54 vol % composite bond material, wherein 90% of the bond material is the metal bond material and 10% of the bond material is the organic material. The bonded abrasive article of sample S1 has approximately 46 vol % abrasive grains and filler material. The bonded abrasive article includes a minor amount of porosity, generally, less than 1 vol %.

The conventional sample (C1) is formed by combining a mixture of large and small diamond grains, wherein the small diamond grains have an average grit of U.S. mesh 140/170 (i.e., 150 microns) and the large diamond grains have an average particle size of U.S. mesh 170/200 (i.e., 181 microns). The large and small mixture of diamond grains are mixed in equal parts.

The mixture of large and small diamonds is mixed with an organic bond material consisting of resin and lime, commonly available as DA69 from Saint-Gobain Abrasives. An amount of SiC grains are also added to the mixture, wherein the SiC grains have an average particle size of 800 U.S. mesh and are available as DA49 800 Grit from Saint-Gobain Abrasives Corporation. Additionally, a minor amount (i.e., 3-4 vol %) of furfural is added to the mixture as DA148, available from Rogers Corporation, N.J., USA.

The mixture is thoroughly mixed and poured into a mold. The mixture is then hot pressed according to the following procedures. Initially, the mixture is placed in the mold and the mixture is heated to 190° C. A full pressure of 3 tons/in$^2$ is then applied for 15 minutes, followed by a cool down. After hot pressing, the formed abrasive undergoes a post-forming bake at 210° C. for 16 hours.

Sample C1 is formed into an abrasive wheel having essentially the same dimensions as the abrasive wheel of Sample S1. Sample C1 has approximately 28 vol % abrasive grains, 42 vol % organic bond material (phenolic resin), approximately 25 vol % of SiC grit (U.S. Mesh 800), and approximately 3-4 vol % furfural. Sample C1 is available from Norton Abrasives as a PCD resinoid grinding wheel. Sample C1 has the same dimensions as the sample S1 wheel.

Samples C1 and S1 are used to grind superabrasive workpieces (i.e., PDC cutting elements having tungsten carbide substrates and polycrystalline diamond abrasive layers) in a centerless grinding operation.

Figure 3:
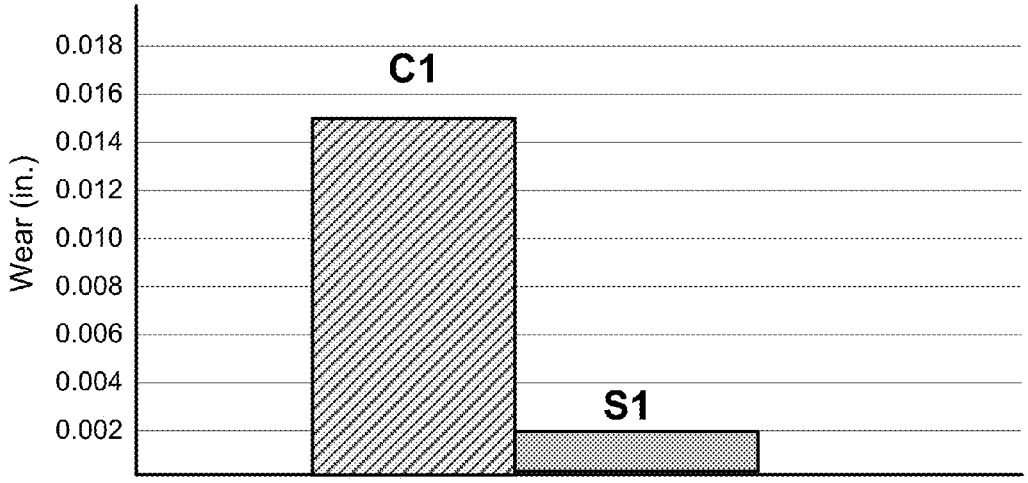
FIG. 3 includes a bar chart of measured average wear (inches) for a sample formed according to embodiments herein compared to a sample representing a conventional abrasive article.

FIG. 3 includes a bar chart of measured average wear (inches) for samples S1 and C1, under wear testing conditions disclosed herein. As clearly illustrated, sample S1 has significantly less average wear than the sample C1. Notably, and quite unexpectedly, sample S1 demonstrates an average wear of approximately 0.002 inches (0.05 mm), which is nearly an order of magnitude less than the average wear of sample C1 of approximately 0.015 inches (0.32 mm) The test results clearly demonstrate sample S1 suffers less wear and has improved durability and life as compared to sample C1.

Figure 4:
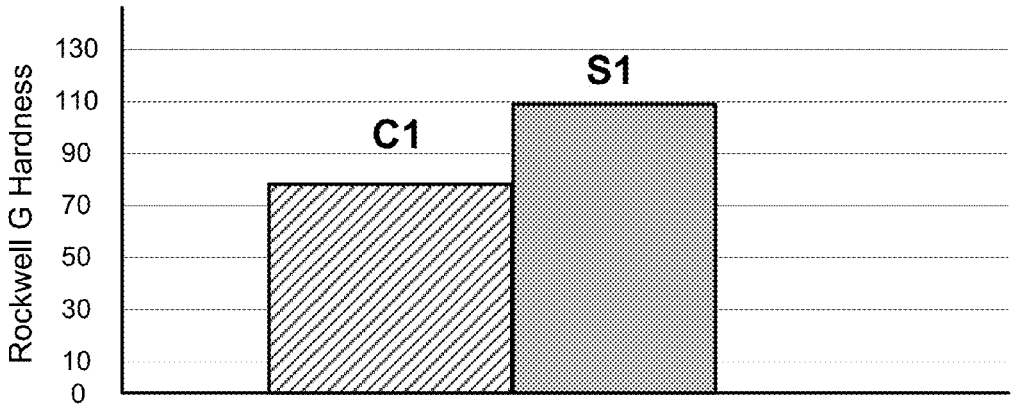
FIG. 4 includes a bar chart of measured hardness for a sample formed according to embodiments herein compared to a sample representing a conventional abrasive article.

FIG. 4 includes a bar chart of measured hardness according to the Rockwell B hardness scale using the standard test described herein, for samples S1 and C1 for the grinding operation noted above. As clearly illustrated, sample S1 has greater hardness than sample C1, indicating improved performance and durability. Notably, sample S1 demonstrates a hardness of approximately 110 Rockwell B, while sample C1 has a hardness of approximately 80 Rockwell B.

Figure 5:
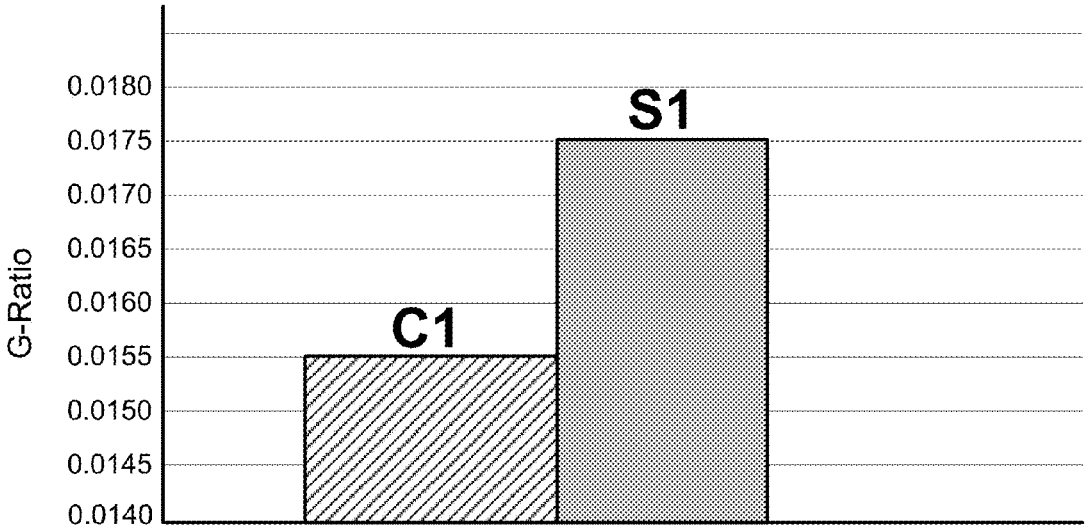
FIG. 5 includes a bar chart of measured G-ratio for a sample formed according to embodiments herein compared to a sample representing a conventional abrasive article.

FIG. 5 includes a bar chart of measured G-ratio (i.e., volume of material removed from the workpiece divided by the volume of wear of the abrasive article) for samples S1 and C1 for the grinding operation noted above. As clearly illustrated, sample S1 has significantly higher G-ratio as compared to sample C1, indicating improved durability and grinding performance over sample C1.

The foregoing bonded abrasive articles of embodiments herein and methods of forming and using such bonded abrasive articles represent a departure from the state-of-the-art. In particular, the bonded abrasive bodies utilize a combination of features including a mixture of abrasive grains, filler material, and composite bond material, present in particular quantities and ratios, sizes, and shapes, which demonstrate improved grinding performance, particularly in the context of grinding of super-hard and/or superabrasive workpieces. In certain aspects, the improved grinding performance is quite unexpected, as the combination of features demonstrated remarkable improvements over conventional bonded abrasive articles tailored for grinding of super-hard workpieces. Notably, without wishing to be tied to a particular theory, it is thought that the unique combination of components (i.e., abrasive grains, filler material, and composite bond material) facilitate improved strength of bonding between the components and a harder, stronger abrasive body. Moreover, the embodiments herein, describe methods of making the bonded abrasive article and the methods of using the bonded abrasive for particular grinding operations represent a departure from the state of the art. It is noted that use of bonded abrasive articles according to the embodiments herein in certain grinding operations allows for more efficient grinding and extended life of the bonded abrasive article.

In the foregoing, reference to specific embodiments and the connections of certain components is illustrative. It will be appreciated that reference to components as being coupled or connected is intended to disclose either direct connection between said components or indirect connection through one or more intervening components to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The disclosure will not be used to interpret or limit the scope or meaning of the claims. In addition, in the foregoing description includes various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments.

What is claimed is:

1. An abrasive article comprising:

a bonded abrasive having a body comprising abrasive grains contained within a composite bond material including an organic material and a metal material, wherein the body further includes a filler material comprising a superabrasive material, the filler material having an average particle size at least about 10 times less than an average particle size of the abrasive grains; and wherein the bond material comprise a ratio (OM/MM) of organic material by volume (OM) to metal material by volume (MM) of not greater than about 0.25.

2. The abrasive article as recited in claim 1, wherein the filler material has an average particle size at least about 12 times less than an average particle size of the abrasive grains.

3. The abrasive article as recited in claim 1, wherein the filler material comprises a metal coating including a transition metal element.

4. An abrasive article comprising:

a body comprising abrasive grains contained within a composite bond material including an organic material and a metal material, wherein the body further includes a filler material comprising titanium coated diamond particles, wherein the filler material is chemically bonded to the composite bond material; and wherein the bond material comprise a ratio (OM/MM) of organic material by volume (OM) to metal material by volume (MM) of not greater than about 0.25.

5. The abrasive article of claim 4, wherein the titanium is chemically bonded to the metal material of the bond at an active region at the interface of the filler material and bond material.

6. The abrasive article of claim 5, wherein the active region comprises an interdiffusion of titanium and the metal material of the composite bond defining a bond region at the surface of the superabrasive particle.

7. The abrasive article as recited in claim 4, wherein an average particle size of the filler material is at least about 10 times less than an average particle size of the abrasive grains.

8. An abrasive article comprising:

a body comprising abrasive grains contained within a composite bond material including an organic material and a metal material, wherein the body further includes a filler material comprising metal-coated superabrasive particles, wherein an average particle size of the filler material and average particle size of the abrasive grains define a bimodal particle size distribution.

9. The abrasive article as recited in claim 8, wherein the average particle size of the filler material is at least about 10 times less than an average particle size of the abrasive grains.

10. The abrasive article as recited in claim 8, wherein the filler material comprises a metal coating including a transition metal element.

11. The abrasive article as recited in claim 8, wherein the bond material comprise a ratio (OM/MM) of organic material by volume (OM) to metal material by volume (MM) of not greater than about 0.25.

12. The abrasive article of claim 8, wherein the composite bond material has a fracture toughness within a range between about 1.5 MPa $m^{0.5}$ and about 3.0 MPa $m^{0.5}$.

13. The abrasive article of claim 8, wherein the organic material comprises polybenzimidazole (PBI).

14. The abrasive article of claim 8, wherein the bond material comprises between about 1 vol % and about 20 vol % organic bond material for the total volume of the bond material.

15. The abrasive article of claim 8, wherein the metal material consists essentially of bronze.

16. The abrasive article of claim 8, wherein the average particle size of the abrasive grains is within a range between about 50 microns and about 400 microns.

17. The abrasive article of claim 8, wherein the average particle size of the filler material is not greater than about 40 times less than an average particle size of the abrasive grains.

18. The abrasive article of claim 8, wherein the body comprises a ratio of filler material to abrasive grains (FM/AG) not greater than about 0.30, wherein FM is the volume percent of the filler material based on the total volume of the body and AG is the volume percent of the abrasive grain based on the total volume of the body.

19. The abrasive article of claim 8, wherein the body comprises at least about 2 vol % and not greater than about 16 vol % filler material for the total volume of the body.

20. The abrasive article of claim 8, wherein the average particle size of the filler material is not greater than about 25 microns and at least about 0.5 microns.

* * * * *